US006690908B1

(12) United States Patent
Gayoso

(10) Patent No.: US 6,690,908 B1
(45) Date of Patent: Feb. 10, 2004

(54) PRINT MEDIA COATING DEVICE AND METHOD

(75) Inventor: Maximo Gayoso, Guadalajara Jalisco (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/280,461

(22) Filed: Oct. 25, 2002

(51) Int. Cl.[7] ..... G03G 15/20; G03G 8/00
(52) U.S. Cl. ..... 399/341; 156/238; 430/97
(58) Field of Search ..... 399/341, 342; 430/97, 99, 124; 156/184, 238, 324, 540

(56) References Cited

U.S. PATENT DOCUMENTS 3,549,447 A * 12/1970 Bresnick ..... 156/151
4,738,555 A 4/1988 Nagashima ..... 400/240
5,370,960 A 12/1994 Cahill et al. ..... 430/124
5,582,669 A 12/1996 Gove et al. ..... 156/239
5,714,305 A 2/1998 Teng et al. ..... 430/271.1

FOREIGN PATENT DOCUMENTS

JP 5-249724 A * 9/1993

* cited by examiner

*Primary Examiner*—Joan Pendegrass

(57) ABSTRACT

One embodiment of the present invention is directed to a print media coating device that includes a web supply, a web take-up, a fuser, and a web cooler downstream in the media path from the fuser. A coating material web runs from the web supply, along the media path through the fuser and the cooler, to the web take-up.

16 Claims, 7 Drawing Sheets

PRINT MEDIA COATING DEVICE AND METHOD

FIELD OF THE INVENTION

The invention is directed to devices and methods for coating print media.

BACKGROUND

It is sometimes desirable to coat printed media with a film of clear flexible material. Such coatings can be formulated and applied to help protect the printed image, enhance the printed image or provide a more uniform gloss level across the entire media (including both printed and unprinted areas). Coatings are applied to print media by overlaying on the media a multi-layered web containing the coating material, and then applying heat and pressure to fuse the coating material to the media. The web typically includes a film/layer of coating material, a carrier (sometimes called a backing), a release layer in between the coating material and the carrier, and an adhesive layer on the coating material to help the coating material adhere to the paper or other print media.

In a conventional single side coating device such as the one illustrated in FIG. 1, a peel bar 2 protrudes slightly into media path 3 downstream from fuser 4 to apply pressure to coating material web 5. Web 5 is threaded through fuser 4 from a supply spool 6 to a take-up spool 7. Coating material web 5 and media sheet 8 are sandwiched together through fuser 4 with the coating material film part of web 5 facing print media sheet 8. Fuser 4 applies heat and pressure to the web/sheet sandwich to melt the adhesive layer and affix the coating material film to the print media, and to soften the release layer. The carrier portion of web 5 angles up off peel bar 2 to take-up spool 7. The point pressure applied by peel bar 2 to web 5 helps the carrier portion of web 5 separate more cleanly from the coating film.

As the adhesive/coating material cools downstream from fuser 4, it cures to become permanently affixed to the print media. It is desirable that the adhesive/coating material cure as much as possible before the carrier is peeled away from the coating material. The more the adhesive/coating material cures before peeling, the better it will adhere to the print media and the less likely peeling will disturb the bond between the coating and the media. Conventional coating devices use only passive cooling. For passive cooling, the distance between the fuser and the peel bar must be long enough and the speed of the web slow enough to allow for the desired cooling.

SUMMARY

Various embodiments of the present invention were developed in an effort to accelerate curing the coating material bond before peeling by actively cooling the web between the fuser and the peel bar. Accordingly, one embodiment of the present invention is directed to a print media coating device that includes a web supply, a web take-up, a fuser, and a web cooler downstream in the media path from the fuser. A coating material web runs from the web supply, along the media path through the fuser and the cooler, to the web take-up.

Another embodiment of the invention is directed to a method for coating print media that includes overlaying the print media with coating material, fusing the coating material to the print media, and after fusing, cooling the coating material.

DETAILED DESCRIPTION

Figure 3:
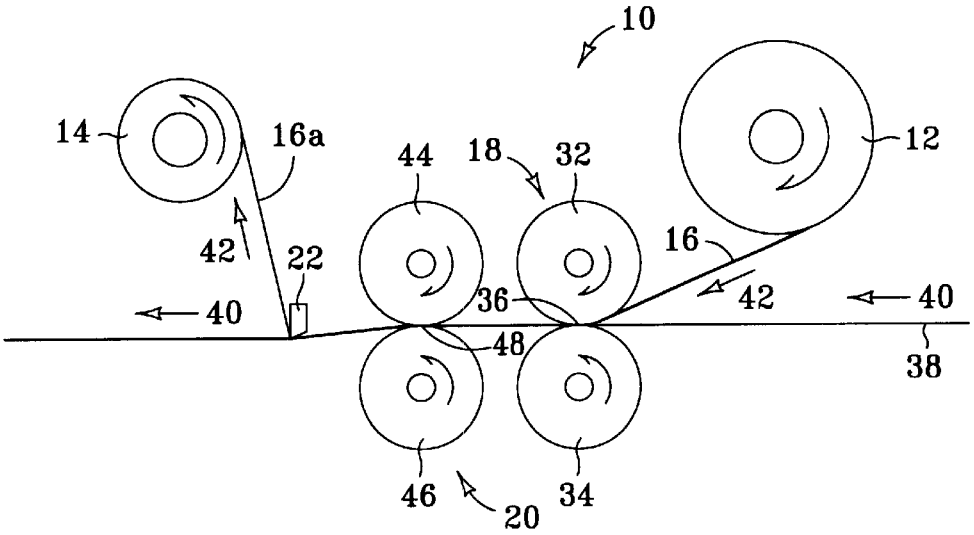
FIG. 3 illustrates a device for coating print media that includes a web cooler, according to one embodiment of the invention.

FIG. 3 illustrates a device for coating a sheet of print media according to one embodiment of the invention. Referring to FIG. 3, coating device 10 includes coating material web supply spool 12 and web take-up spool 14. A coating material web 16 runs from supply spool 12 through a fuser 18 and a cooler 20, and over a peel bar 22 to take-up spool 14. Web 16 represents generally any web that carries a coating film suitable for use with paper and other types of print media.

Figure 1:
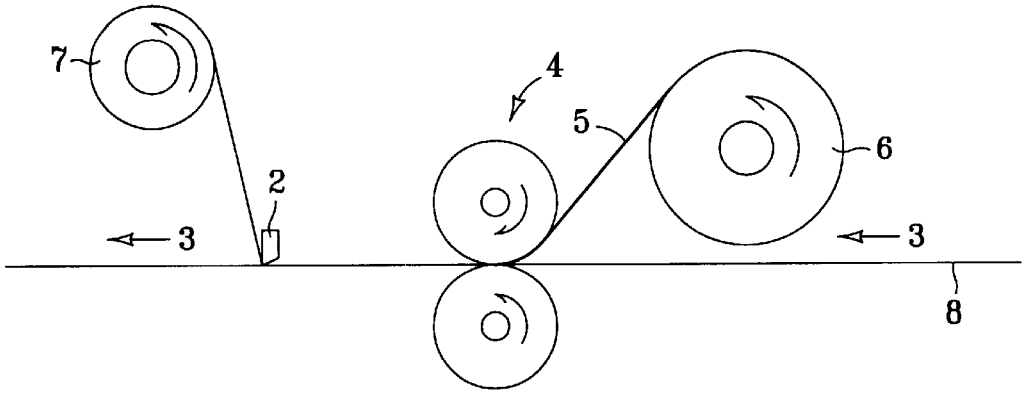
FIG. 1 (Prior Art)
FIG. 1 illustrates a prior art device for coating print media.
Figure 2:
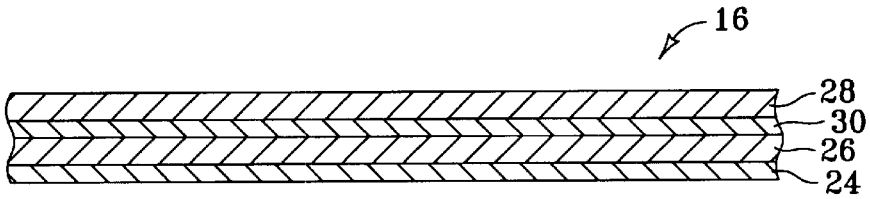
FIG. 2 illustrates a coating material web.

FIG. 2 is a section view illustrating one example of a web suitable for use in coating device 10. Referring to FIG. 2, web 16 includes a layer of adhesive material 24, a layer of coating material 26 on adhesive layer 24, a carrier 28 or backing as it is sometimes called and a release layer 30 interposed between carrier 28 and coating material 26. Suitable webs include, for example, the clear flexible film webs described in pending Hewlett-Packard patent application Ser. No. 10/167,891 filed Jun. 11, 2002 and entitled "Images Printed On Porous Media And Coated With A Thermal Transfer Overcoat."

Fuser 18 represents generally any suitable device for applying heat or pressure or both to the web/media sandwich to cause coating 26 to bond to the paper or other print media. In the embodiment illustrated in FIG. 3, fuser 18 includes a pair of opposing rollers 32 and 34 that rotate against one another to form a fuser nip 36. A conventional fuser such as the roll type fuser used in a laser printer may be adapted for use as fuser 18 in coating device 10. In one example of such a fuser, which is shown in FIG. 3 and in more detail in FIG. 5, roller 32 is constructed as a heated fuser roller and roller 34 is constructed as a compliant pressure roller.

When a coating across the full width of the paper or other print media 38 is desired, as will typically be the case, web 16 and the corresponding supply and take-up spools are about the same width as the print media, as best seen in FIG.

5. Print media sheet 38 moves through fuser 18 along a media path 40. Web 16 moves from supply spool 12 through fuser 18 and cooler 20, over peel bar 22 to web take-up spool 14 along a web path 42. Print media path 40 and web path 42 converge at fuser nip 36, are coincident with one another through fuser 18 and cooler 20, and then diverge at peel bar 22 as the now spent web 16*a* is taken up to take-up spool 14. The combination of heat and pressure applied to web 16 and media sheet 38 as they pass through fuser nip 36 melts adhesive layer 24 into sheet 38 to bond coating 26 to the top of sheet 38, and softens release layer 30. Cooler 20 cools web 16 and sheet 38 to accelerate curing the bond between the coating 26 and sheet 38. Accelerated curing strengthens the bond between coating 26 and sheet 38 and allows carrier 28 to separate more cleanly from coating 26 at peel bar 22. Spent web 16*a* taken up on spool 14 consists of carrier 28 and the remnants of release layer 26.

Figure 5:
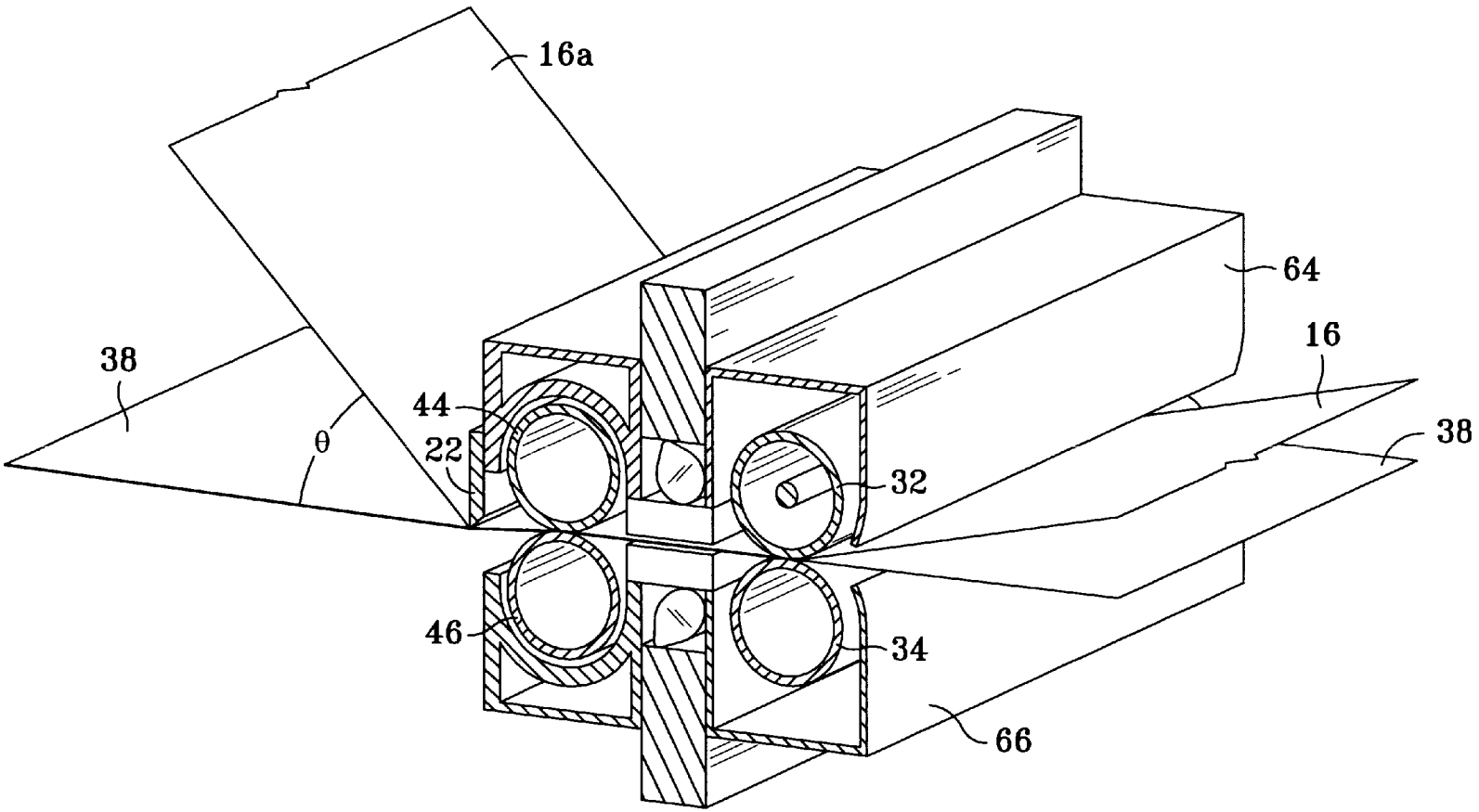
FIG. 5 illustrates the fuser and cooler module of a coating device such as the one shown in FIG. 4.

In the embodiment of FIGS. 3 and 5, cooler 20 is constructed as a pair of opposing rollers 44 and 46 that rotate against one another to form a cooler nip 48. Cooler 20 operates as a heat sink to draw heat away from web 16. Cooling rollers 44 and 46 may be constructed as relatively large masses of thermally conductive material. In this context, "relatively large" refers to the relationship between the thermal mass of the cooling rollers and the thermal mass of the web/media sandwich. Alternatively, one or both cooler rollers 44 and 46 may be actively cooled, for example, by circulating air through the rollers, to present the desired heat sink to web 1 6. Rotating rollers are desirable because they increase the cooling surface contact area. Opposing rollers simultaneously contact and draw heat away from both sides of the web/sheet sandwich.

Downstream from cooler 20, web 16 passes over a peel bar 22. Peel bar 22 extends across the width of web 16 and protrudes slightly into web path 42. Web path 42 diverges from media path 40 at peel bar 22 at a sharp angle θ, preferably 60° to 130°, to help carrier 28 break more cleanly away from coating layer 26.

Although the various operating parameters associated with cooler 20 may be varied as necessary or desired to optimize performance, testing has shown that cooling rollers 44 and 46 with 2 mm thick aluminum walls spaced 50 mm from fusing rollers 32 and 34 and 35 mm from peel bar 22 provide the desired accelerated cooling when air is blown through cooling rollers 44 and 46 and blown directly over web 16.

Figure 4:
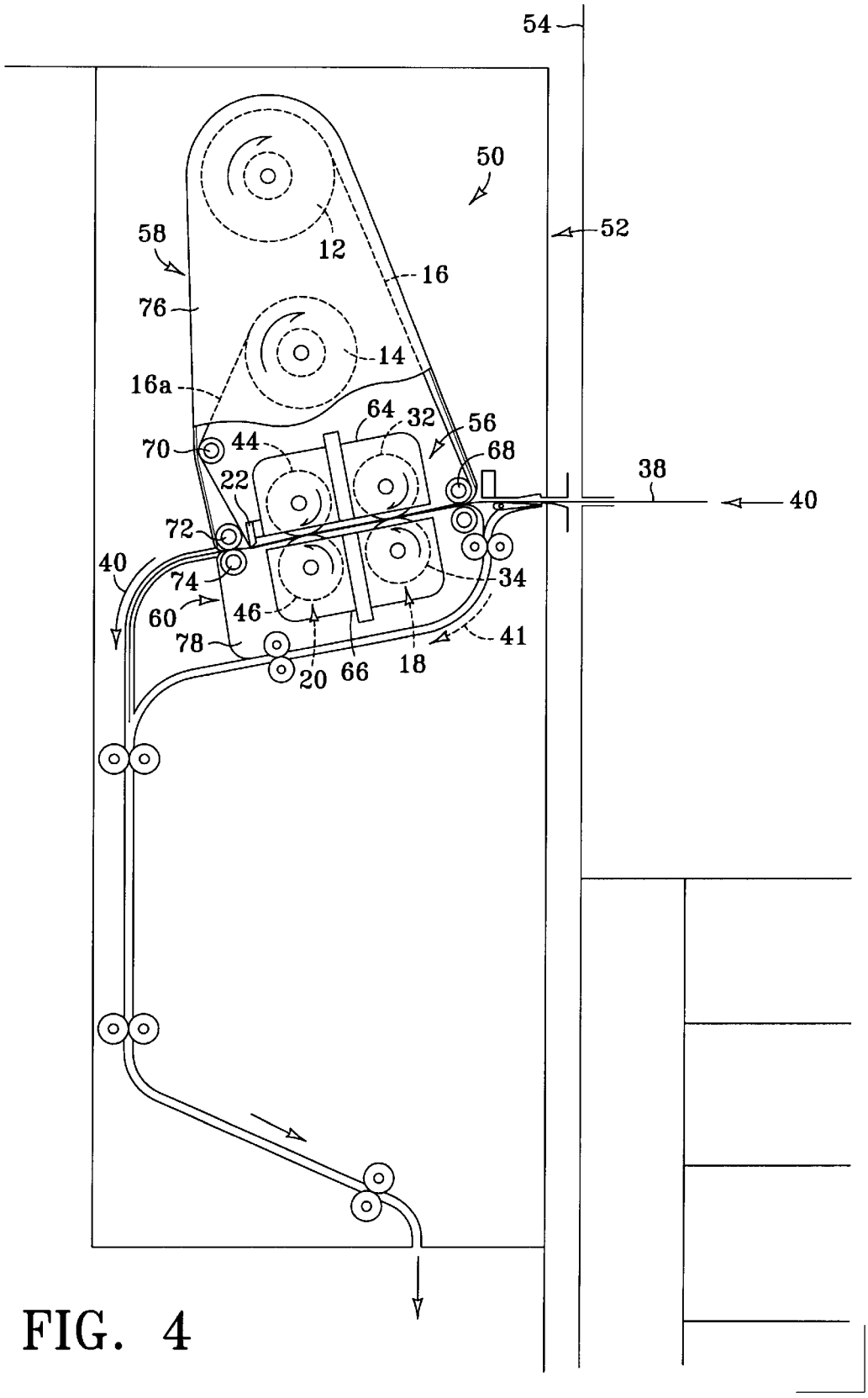
FIG. 4 illustrates a modular coating device according to one embodiment of the invention installed in a post print finishing device.
Figure 6:
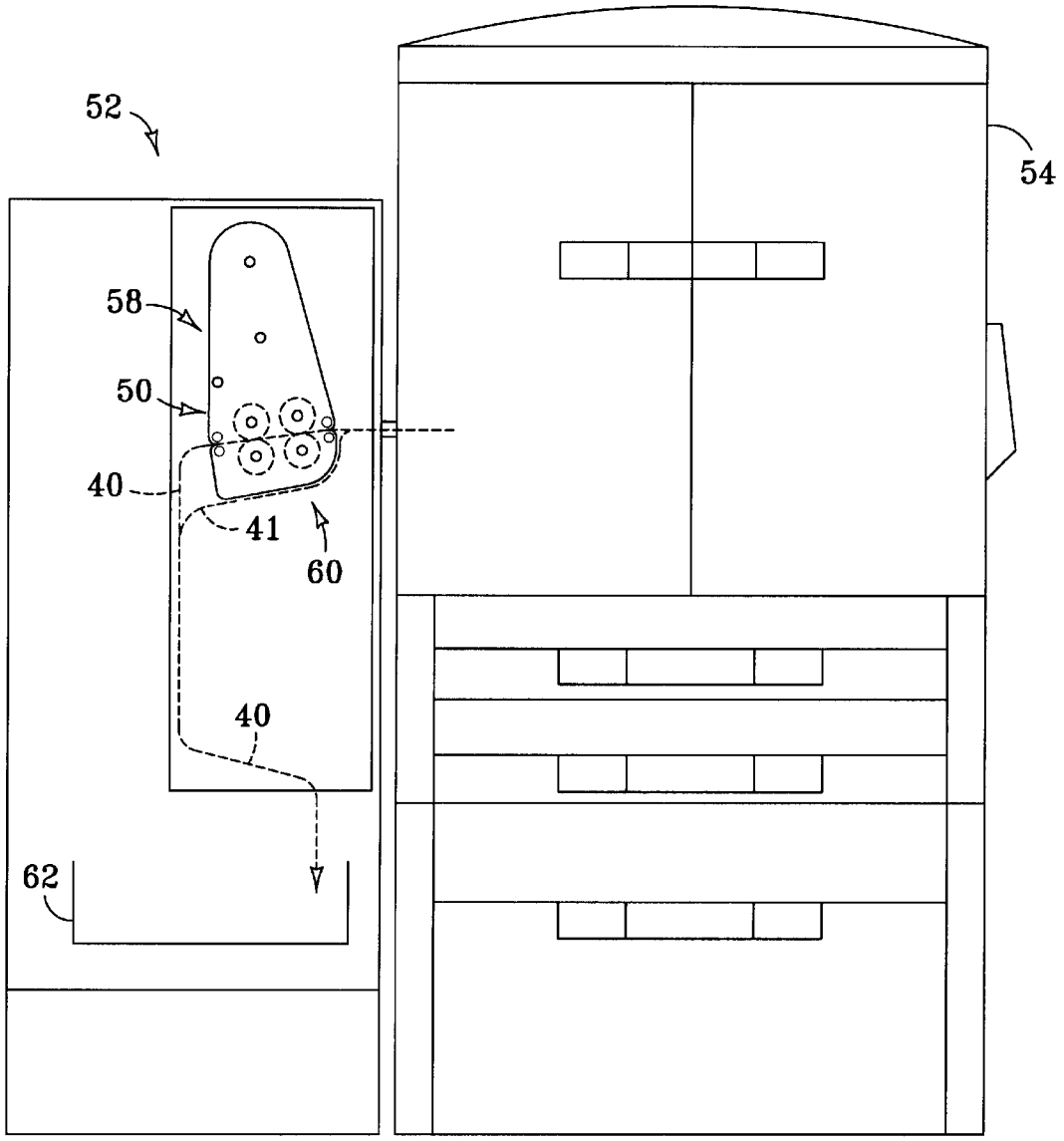
FIG. 6 illustrates a modular coating device according to one embodiment of the invention installed in a post print finishing device attached to a printer.

FIGS. 4 and 6 illustrate a modular coating device 50 installed in a post-print finishing device 52 operatively coupled to a printer 54. FIG. 5 is a detailed view of the fuser/cooler module 56 of coating device 50. Referring to FIGS. 4–6, modular coating device 50 includes an upper module 58 and a lower module 60. Two print media paths are provided through post print finishing device 52. A coating media path 40 runs through coating modules 58 and 60 and a bypass media path 41 bypasses coating modules 58 and 60. Both media paths 40 and 41 discharge sheets 38 to an output tray 62 or to other downstream finishing operations.

Upper module 58 includes a web supply spool 12, web take-up spool 14, and an upper fuser and cooler unit 64 that houses the upper fuser and cooler rollers 32 and 44. Lower module 60 includes a lower fuser and cooler unit 66 that houses lower fuser and cooler rollers 34 and 46. Web 1 6 runs from supply spool 12 through fuser and cooler unit 64 to take-up spool 14 around idler rollers 68 and 70. An exit drive roller 72 and associated pinch roller 74 propel media sheets 38 out of coating device 50 toward output tray 62. Each of the rollers in upper coating module 58 are mounted to or otherwise supported by an upper module frame 76. Each of the rollers in lower coating module 60 are mounted to or otherwise supported by a lower module frame 78.

The various components of coating device 50 may be directly supported by the frame, such as by mounting a component directly to the frame, or components may be indirectly supported by the frame, such as by mounting a component to a support structure or other component that is mounted to the frame. The frame that supports the components may be a module frame, as in upper module frame 76 and lower module frame 78, an overall coating device frame, or the post print finishing device frame such as might be the case where the coating device is not constructed of modular units that slide into and out of the finishing device.

Figure 7:
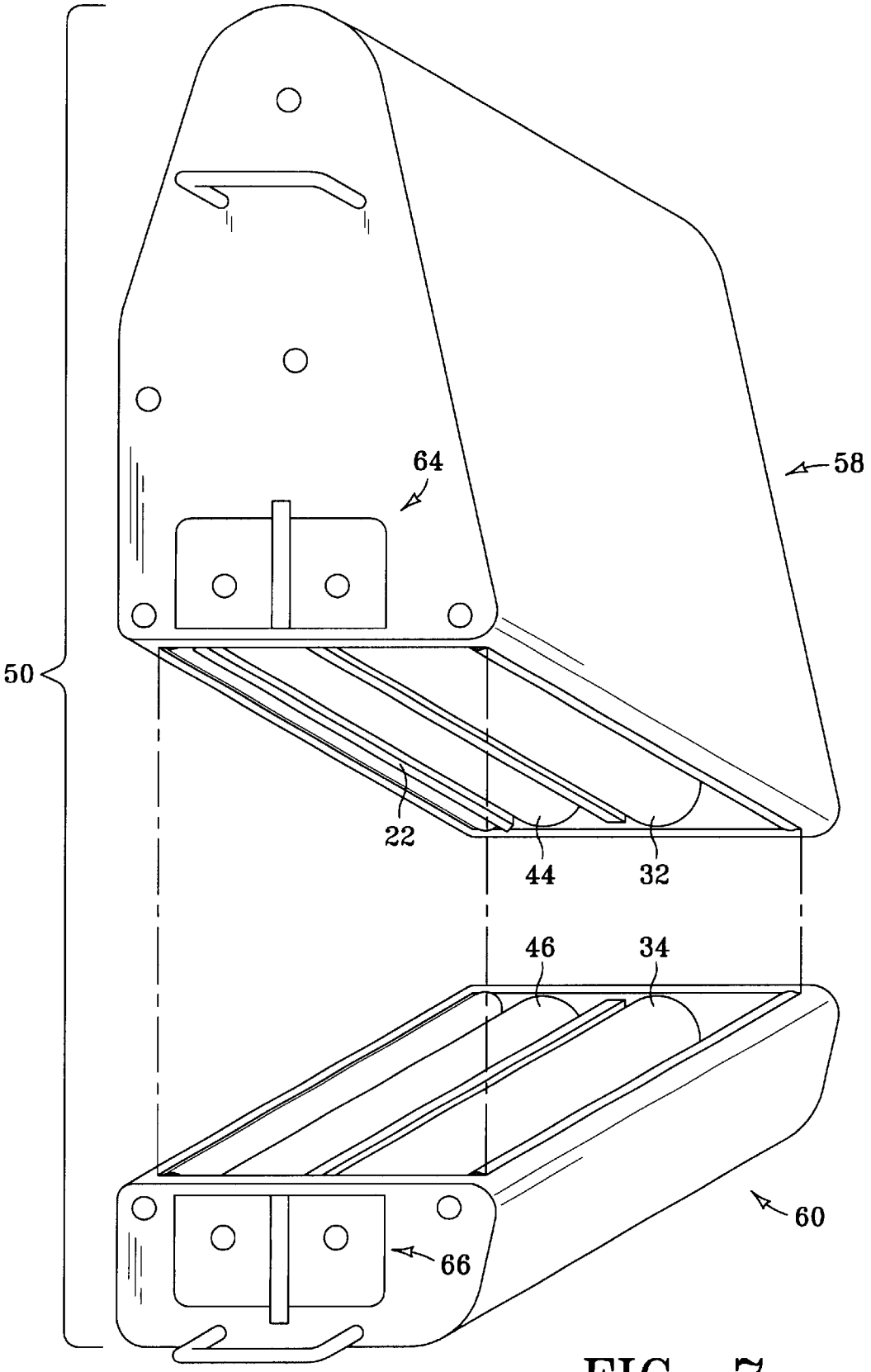
FIG. 7 is a perspective view of an upper and lower coating module according to one embodiment of the invention.

FIG. 7 is a perspective view of upper module 58 and lower module 60 configured to slide into and out of post print finishing device 52 to facilitate installation, repair and replacement of each module.

Figure 8:
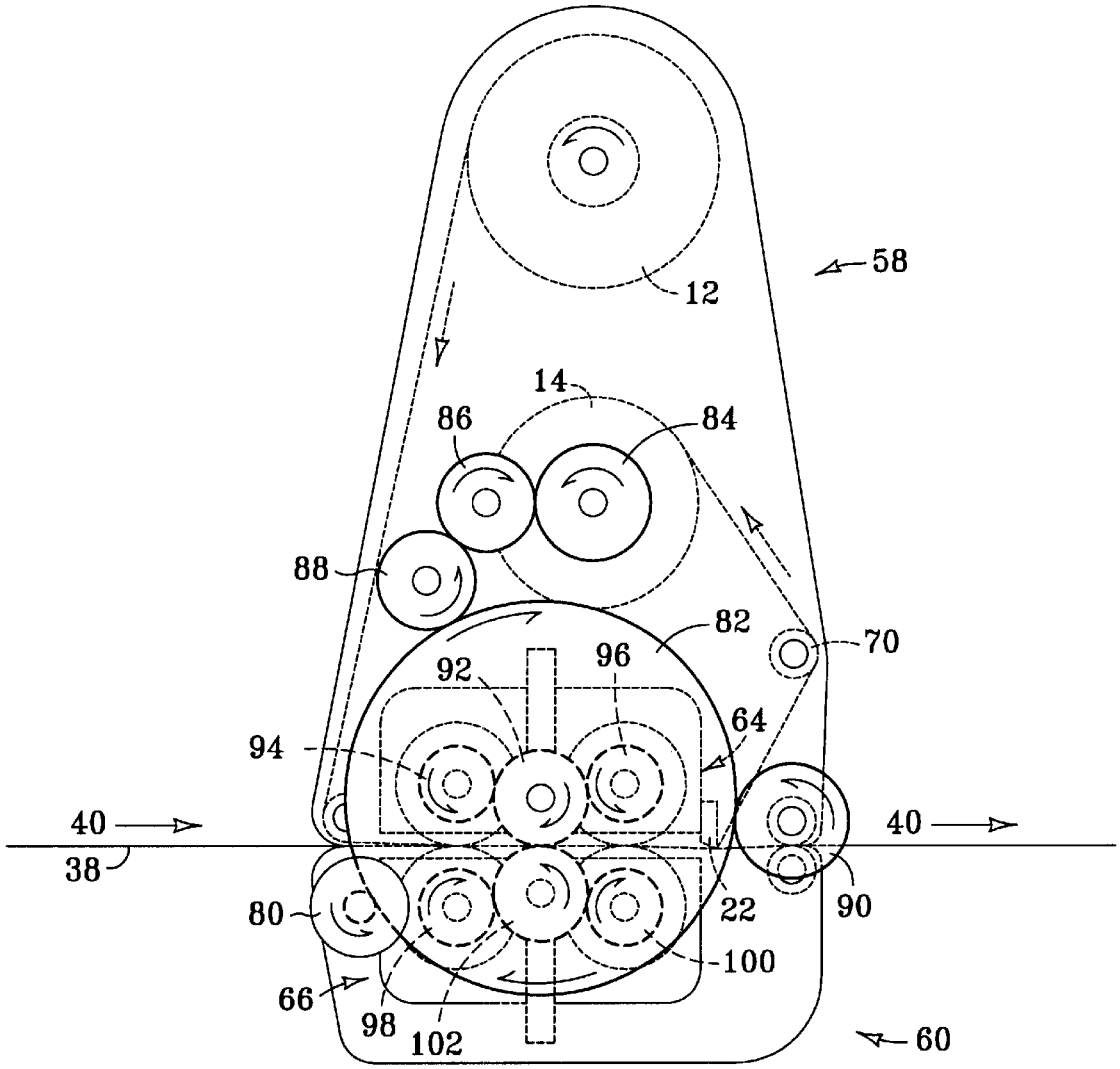
FIG. 8 illustrates a drive train for the driven components of a modular coating device according to one embodiment of the invention.

FIG. 8 illustrates a drive train for driven components of modular coating device 50. In the drive train shown in FIG. 8, all of the major components in media path 40 and web path 42 (not shown in FIG. 8) are driven by one motor. Other drive train configurations are possible and two or more motors could be used to drive the various components. Referring to FIG. 8, main drive stepper motor 80 drives main drive gear 82 clockwise. Web take-up gear 84, which is coupled to web take-up spool 14, is driven counter-clockwise off main gear 82 through a pair of reversing spacer gears 86 and 88. Exit drive gear 90, which is coupled to exit drive roller 72, is driven counter-clockwise directly off main gear 82.

Center drive gear 92, which turns coaxially with main gear 82, is driven clockwise at the urging of motor 80. Upper fuser roller gear 94, which is coupled to upper fuser roller 32, and upper cooler roller gear 96, which is coupled to upper cooler roller 44, are driven counter-clockwise off center drive gear 92. Lower fuser roller gear 98, which is coupled to lower fuser roller 34, and lower cooler roller gear 100, which is coupled to lower cooler roller 46, are driven clockwise off center drive gear 92 through a center spacer gear 102.

Although not shown, the drive train illustrated in FIG. 8 may also include clutches interposed between some of the drive elements as necessary or desirable to maintain the appropriate relationship among moving parts. For example, electro-magnetic slip clutches should be included at take-up gear 84 to help control the tension on coating web 16 and 16*a*.

Figure 9:
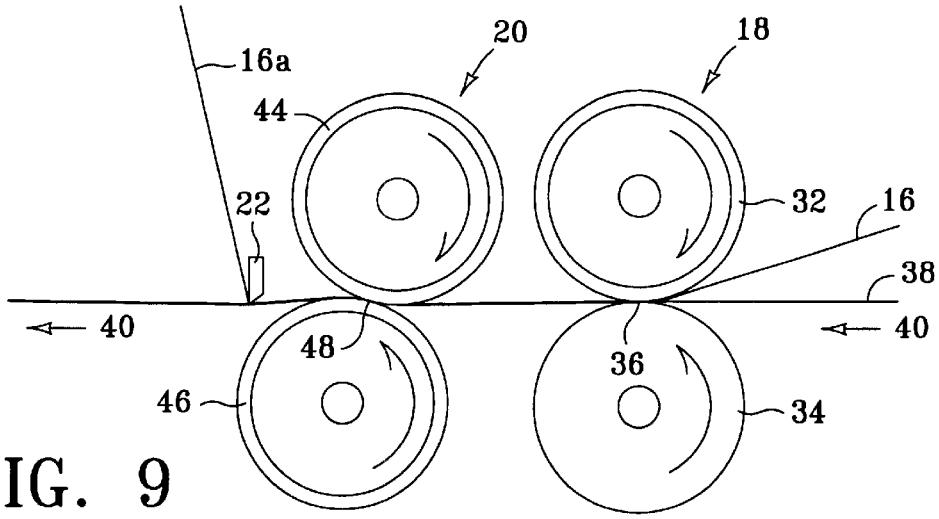
FIG. 9 illustrates one embodiment of a cooler in which upper and lower rollers are off-set from one another.

In an alternative embodiment of cooler 20 illustrated in FIG. 9, upper and lower cooler rollers 44 and 46 are offset from one another so that the web/media sandwich wraps partially around each roller to increase the cooling surface contact area.

Figure 10:
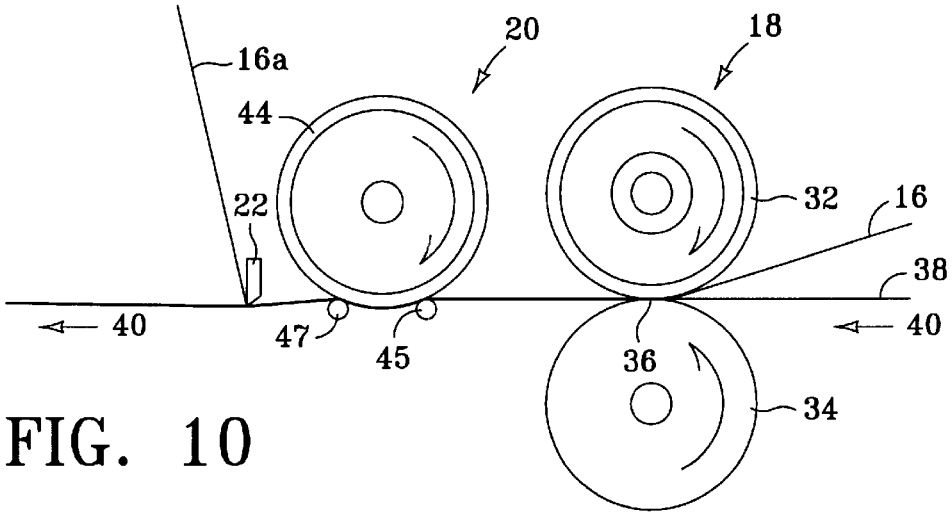
FIG. 10 illustrates one embodiment of a cooler in which idler rollers are used to partially wrap the web/media sandwich on a cooling roller.

In an alternative embodiment of cooler 20 illustrated in FIG. 10, a single cooler roller 44 is used in conjunction with a pair of idler rollers 45 and 47 positioned immediately adjacent opposite sides of roller 44. Rollers 45 and 47 hold the web/media sandwich against roller 44 so that the web/media sandwich partially wraps roller 44 to increase the cooling surface contact area.

Figure 11:
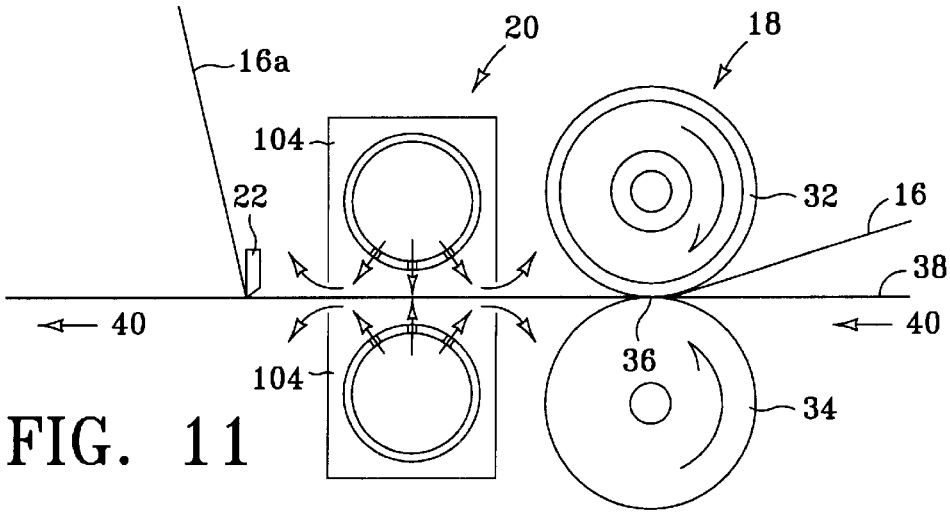
FIG. 11 illustrates one embodiment of a cooler in which cooling air channels are used to direct cooling air over the web/media sandwich.

In an alternative embodiment of cooler 20 illustrated in FIG. 11, cooling air is blown over the web/media sandwich through channels 104.

While the present invention has been shown and described with reference to the foregoing exemplary embodiments, it is to be understood that other forms, details, and embodiments may be made without departing from the spirit and scope of the invention which is defined in the following claims.

What is claimed is:

1. A print media coating device, comprising:

a web supply;

a web take-up;

a fuser defining a media path therethrough;

a web cooler defining a continuation of the media path therethrough down stream from the fuser; and a coating material web running from the web supply, along the media path through the fuser and the cooler, to the web take-up.

2. The device of claim 1, further comprising a peel bar disposed along the media path between the web cooler and the web take-up, the peel bar protruding into the web path such that the web passes over and contacts the peel bar.

3. The device of claim 1, wherein the fuser comprises a pair of rollers engagable with one another to form a fuser nip and the fuser nip defines the media path through the fuser.

4. The device of claim 1, wherein the cooler comprises a pair of rollers engagable with one another to form a cooler nip, the cooler nip defining the media path through the cooler.

5. The device of claim 4, wherein at least one of the cooler rollers is actively cooled.

6. The device of claim 4, wherein the rollers are off-set from one another such that the web wraps partially around each roller.

7. The device of claim 1, wherein the cooler comprises a roller contacting the web.

8. The device of claim 1, wherein the cooler comprises an actively cooled roller contacting the web.

9. A print media coating device, comprising:

a rotatable web supply spool proximate a media path;

a rotatable web take-up spool proximate the media path downstream from the web supply spool along a web path that begins at the supply spool and ends at the take-up spool;

a fuser disposed along the media path and the web path between the supply spool and the take-up spool;

a cooler disposed along the media path between the fuser and the take-up spool; and the media path and web path coincident with one another through the fuser and the cooler.

10. The device of claim 9, further comprising a coating material web on the web supply spool, the web having a layer of coating material and a carrier carrying the layer of coating material.

11. The device of claim 9, further comprising a coating material web running from the web supply spool along the web path to the web take-up spool, the coating material web having a first portion upstream from the cooler that includes a layer of coating material and a second spent portion downstream from the cooler from which substantially all of the coating material has been removed.

12. The device of claim 9, further comprising a peel bar disposed along the media path downstream from the cooler and the peel bar protruding into the web path such that the web passes over and contacts the peel bar.

13. The device of claim 12, wherein the media path and the web path converge into the fuser and diverge from the peel bar.

14. The device of claim 9, further comprising a motor drivingly coupled to the web take-up spool, a fuser roller and a cooler roller.

15. The device of claim 14, further comprising:

a main drive gear drivingly coupled directly to the motor;

a center drive gear mounted coaxially with the main drive gear;

a web take-up gear coupled to the web take-up spool;

first and second reversing spacer gears engaging one another, the first reversing, spacer gear engaging the main drive gear and the second reversing spacer gear engaging the web take-up gear;

a fuser gear coupled to the fuser roller, the fuser gear engaging the center drive gear; and a cooler gear coupled to the cooler roller, the cooler gear engaging the center drive gear.

16. A method for coating print media, comprising:

providing a coating material web having a coating material and a carrier carrying the coating material;

overlaying the print media with the coating material web;

fusing coating material to the print media;

after fusing, contacting the coating material web with a heat sink; and peeling the carrier from the coating material.

* * * * *